United States Patent [19]

Veith

[11] 4,312,501

[45] Jan. 26, 1982

[54] APPARATUS FOR PATTERN-ALIGNED STACKING OF FABRIC WEB SECTIONS

[75] Inventor: Gustav G. Veith, Frasdorf, Fed. Rep. of Germany

[73] Assignee: Gustav Georg Veith GmbH, Frasdorf, Fed. Rep. of Germany

[21] Appl. No.: 113,255

[22] Filed: Jan. 18, 1980

[30] Foreign Application Priority Data

Jan. 30, 1979 [DE] Fed. Rep. of Germany ..... 2903473

[51] Int. Cl.[3] ..... B65H 29/46

[52] U.S. Cl. ..... 270/30; 2/243 B; 38/102.91

[58] Field of Search ..... 270/30–31; 2/243 B; 112/217.1; 38/137–140, 102.91

[56] References Cited

U.S. PATENT DOCUMENTS

| | | | |
|---|---|---|---|
| 827,949 | 8/1906 | Wilkins | 38/138 |
| 2,495,468 | 1/1950 | Mueller | 38/137 |
| 3,580,640 | 5/1971 | Eriksson | 198/493 |

FOREIGN PATENT DOCUMENTS

| | | | |
|---|---|---|---|
| 1814922 | 7/1970 | Fed. Rep. of Germany | 270/30 |
| 173406 | 1/1922 | United Kingdom | 270/31 |
| 1182107 | 2/1970 | United Kingdom | 270/30 |

*Primary Examiner*—Edgar S. Burr

*Assistant Examiner*—A. Heinz

*Attorney, Agent, or Firm*—James E. Nilles; James R. Custin

[57] ABSTRACT

A method of pattern-aligned stacking of fabric web sections to be cut to the component cuttings of a textile product in accordance with a cutting pattern. The fabric web sections are consecutively impaled on at least one height-adjustable needle row projecting through a stacking table transversely of the fabric running direction, the cutting pattern is laid upon the stacking table, at least two longitudinally adjustable needle rows are aligned in the longitudinal direction of the table to coincide with edge portions of the cuttings to be joined to one another in finishing said textile product. The fabric web sections are then impaled on mutually correlated needle rows along identical transverse lines of the fabric pattern repeat.

A stacking table for carrying out the above method and including a table top provided with openings for the needle rows and a height-adjustable transverse support for the needles below said table top. The table top consists of table top strips extending in the running direction of the fabric and defining slots for said needles between themselves, and transverse supports for the needles are located below the table top in a manner enabling them to be shifted in running direction and locked in any desired position.

8 Claims, 12 Drawing Figures

APPARATUS FOR PATTERN-ALIGNED STACKING OF FABRIC WEB SECTIONS

BACKGROUND OF THE INVENTION

The German prior art DE-OS No. 1,814,922 discloses a method and apparatus wherein consecutive fabric web sections are impaled on a needle row at identical transverse lines of the fabric pattern. The fabric patterns of the individual layers are substantially aligned above one another, so that after cutting of the stack, the individual cuttings have substantially identical patterns. This method has several disadvantages, it does not, for instance, take into consideration that the length of the pattern repeats may vary over the length of a bale of fabric. This length variation can result from variations of the fabric tension during weaving as caused, for example, by the weight of the already woven web. In this case, proper alignment of the pattern is achieved only in the region impaled on the needles, but not in areas remote therefrom. Furthermore, in the mass production of textile products, particularly of products with checkered or striped patterns, it is of less importance that each such product carries the same pattern at exactly the same location, than that the patterns of adjacent cuttings are exactly aligned relative to one another along certain seams of the finished product. If this is to be achieved in the known method, it is necessary either to specifically adapt the cutting pattern to the pattern repeat of the fabric to be cut, or to cut any one of two cuttings to be interconnected with aligned pattern to a rough shape with a substantial amount of surplus fabric at least in the lengthwise direction, and to subsequently cut the respective cutting to its final shape with properly aligned pattern. In the first case, the adaptation of the cutting pattern to the given fabric pattern repeat requires complicated preparations for each individual size of the textile products and, if similar products are to be made of fabrics having different patterns, individual cutting patterns have to be provided and adapted for each fabric pattern. But even in this case, proper alignment of the fabric pattern is not achieved if the above mentioned variation of the pattern repeat occurrs in the web sections of a single stack. The second possibility of carrying out this method results in a substantial waste of fabric for the oversize pre-cuttings and doubled cutting work, and is thus very uneconomical.

SUMMARY OF THE INVENTION

It is an object of the invention to provide a method and apparatus therefor permitting correlated cuttings to be cut with exactly aligned patterns in a stack of fabric web sections with minimum waste of fabric and working time.

The method according to the invention permits any number of pattern-correlated cutting portions to be established, e.g. adjacent skirt cuttings, coat front and back cuttings, coat front cuttings and sleeves etc.. This permits the cutting pattern to be designed for optimum fabric yield, it being not necessary to align correlated cuttings along the same transverse line on the cutting pattern. The give fabric area can thus be fully utilized, since the free intermediate areas may be used for cuttings not correlated with the pattern. Slight variations of the pattern repeat can be tolerated, since the mutually abutting portions are exactly aligned, and variations remote from the abutting portions are scarcely noticable. Since consecutive layers are impaled on each needle row in pattern-aligned relationship, the cuttings of all simultaneously cut layers are interchangeable. A further substantial advantage of the method consists in the fact that the needle rows initially set for a given cutting pattern may be employed for stacking fabrics of different patterns for making otherwise identical textile articles. Furthermore, a changeover to a cutting pattern for a similar textile article of different size requires only minimum resetting. The entire method may thus be carried out in a very simple manner even by unskilled personnel. Of particular importance is the saving of fabric resulting from improved utilization of the area required for the cutting pattern and, as compared to the above explained known method, from the saving of the extra length required for pattern adaptation.

A length compensation for aligning the pattern repeat relative to the correlated needle rows can be carried out in a simple manner at a separation zone extending substantially in transverse direction between the cuttings. This separation zone, which has to be provided already on the cutting pattern, permits any excess length existing between pattern repeats to be taken up by folding the fabric over itself. If the spacing between pattern repeats is too small, the fabric web section can be cut at the separation zone, so that the cut portions can be shifted for pattern adaptation. This permits particularly upper fabric layers with slight pattern repeat variation to be aligned.

The invention further provides a novel stacking table for carrying out the method. The prior stacking table known from DE-OS No. 1,814,922 is provided with recesses for the needles and a height-adjustable transverse support for the needles below the table top. The height-adjustment capability permits the needles to be pushed upwards through the stack already formed thereon for impaling the subsequent fabric layer. The transverse needle support is mounted in stationary table brackets by means of a height-adjustment screw. There is thus only a single needle row available for stacking extending transversely of the table top at a fixed location. In contrast thereto, the table top of the stacking table according to the invention consists of a plurality of longitudinally extending strips defining needle slots therebetween, and the transverse needle supports are mounted below the table top for longitudinal adjustment and fixation at any position. The continuous longitudinal slots between the table top strips permit the needle rows to be adjusted to any position. It is even possible to shift the transverse needle supports with the needle points projecting between or even above the table top strips.

In an advantageous embodiment, the stacking table may comprise a rectangular frame having longitudinally extending lateral frame members and parallel girders carrying the table top strips. The transverse supports for the needle rows may be slidably mounted on the lateral frame members by means of sliding shoes. They are thus guided on both sides of the table and readily accessible for adjustment.

In order to permit the needle supports to be operated from one side of the table only without the danger of jamming, each needle support has a u-shaped sliding shoe straddling the upper edge of the lateral frame member at one side, and at the other, an L-shaped sliding shoe with one of its legs resting on top of the respective frame member so as to provide a limited freedom of movement in the lateral direction. This mounting of the needle supports is additionally improved by the sliding shoes being pivotally connected to the supports about vertical axes.

The needle rows may be fixed at any selected position by means of an eccentric disc pressing the respective sliding shoe against the frame member.

In a preferred embodiment of the stacking table according to the invention, each needle support includes an upper cross member connected to the sliding shoes at a fixed height, and a lower cross member connected to the upper cross member in a height-adjustable manner. In this arrangement, the upper cross member serves as the longitudinally shiftable carrier for the lower height-adjustable cross member supporting the needles. This latter member is thus not subjected to any loads or torsional forces during adjustment. It may therefore be of lightweight construction and readily detachable from the upper cross member as for the insertion of needles.

In an advantageous embodiment, both cross members are provided with vertical guiding and locking means for the needles. The upper cross member thus also serves as a needle guide during height adjustment. It is also possible, however, to support the needles in the upper cross member, for instance if they shall project rather high above the table top for forming a particularly high stack.

In some cases it may be desirable not to employ all needles of a transverse row for impaling the fabric web sections. For such cases, the needles are mounted in receptacles having locking means for selectively locking the needles in the upper or lower cross member. If a needle is not to be raised above the table top, it is locked in the upper cross member and unlocked in the lower cross member. If the lower cross member is then raised, the respective vertical guide slides over the mounting receptacle of the associated needle, so that the latter is not raised. It is thus not necessary to bodily remove the respective needle.

In a preferred embodiment, each needle receptacle consists of a quadrangular body having at least two recesses formed therein at different height, and each cross member carries tubular guide sleeves for each needle receptacle, the locking means being formed by recesses in the guide sleeves and retaining clips insertible therethrough into the receptacle recesses. This arrangement enables the needles to be simply and rapidly locked in the cross members. The locking clips are interchangeable.

A particularly simple and safe method for changing the locking attachment of a needle between the upper and lower cross members is achieved in an advantageous embodiment of the invention, wherein the upper and lower recesses of the needle receptacles are each formed at a corner of the quadrangular cross-section and offset by an angle of 90° relative to another, the recesses in the guide sleeves are offset at an angle of 45° relative to one another, and each locking clip is substantially U-shaped, with the spacing between its legs being greater than the length of one side of the quadrangular body and smaller than the diagonal dimension thereof. The locking clips are inserted into the recesses of the guide sleeves, so that their respective positions are displaced by an angle of 45° relative to one another. In this manner, the quadrangular body is located between the legs of one of the two locking clips, with its side faces parallel thereto, while assuming a diagonal position with respect to the other clip, so that a leg thereof engages the respective recess to lock the quadrangular body in the associated cross member. Rotation of the needle receptacle or socket about an angle of 45° causes this situation to be reversed, i.e. the locking clip associated with the other cross member engages the respective recess to lock the needle socket in this cross member. At the same time it is released by the other clip for free movement relative to the other cross member. It is thus not nedessary to remove a locking clip in order to release the locking engagement.

In an advantageous embodiment, the quadrangular body may be provided with two recesses each at diagonally opposite corners of its upper portion, and at the two other corners of its lower portion. This results in both legs of a locking clip engaging a respective recess of the needle socket in the locking position thereof, so that the socket is safely retained. In addition, this arrangement permits the locking engagement to be changed over by rotating the needle socket about an angle of 45° in any direction.

Each recess may have the form of an equilateral rectangular triangle with inwardly arched hypotenuse. The thus rounded edge of the quadrangular body forms a smooth sliding surface for the legs of the locking clip during rotation.

The construction of the stacking table with individual table top strips and associated girders makes it possible to facilitate handling of the heavy stacks in a structurally simple manner by providing the table top strips with air jets connected to an air blower via air channels formed in the girders. This feature permits a carrying air cushion to be established over the stacking surface for shifting and removing the stack.

The air channels may advantageously be subdivided by flaps and partitions into a shifting zone and a removal zone to be selectively supplied with air. This permits a controlled air supply to below the stack. By initially supplying air to the shifting zone, the finished stack may be lifted for easy shifting, whereupon its movement towards the removal end of the table is facilitated by supplying air to both zones. Finally the air supply may be restricted to the removal zone in order to facilitate removal of the stack from the table.

In an advantageous embodiment, the air jets of the shifting zone may be connected to the blower via a transverse channel at each end of the table and the air channels within the laterally outer girders. The air jets of the removal zone may be connected to the blower via the air channels of all girders and a transverse channel, the blower being advantageously located adjacent the removal zone.

Control of the air flow is advantageously achieved by means of a first closure flap between the two transverse channels adjacent the blower, and second closure flaps in the air channels of the laterally outer girders. Depending on the position of these flaps it is possible to supply air to any one of said zones or to both zones simultaneously.

DESCRIPTION OF THE PREFERRED EMBODIMENT

A stacking table generally indicated at 1 has a table top consisting of individual strips 2. Strips 2 extend in the longitudinal direction of table 1, which is also the running direction of the fabric webs to be stacked thereon.

Figure 2:
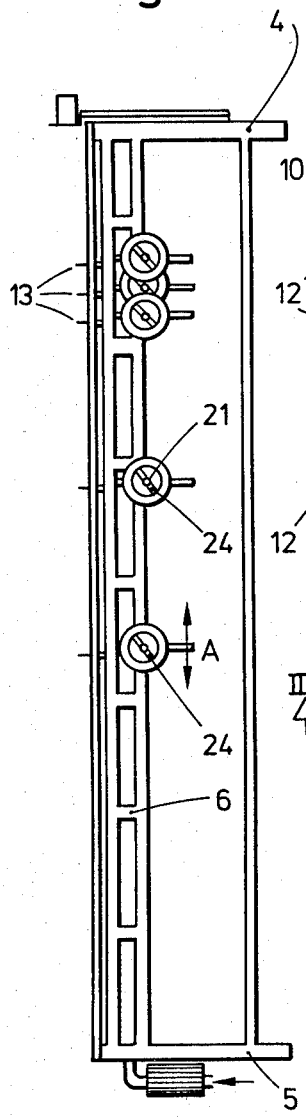
FIG. 2 shows a diagrammatical side view of the table.
Figure 1:
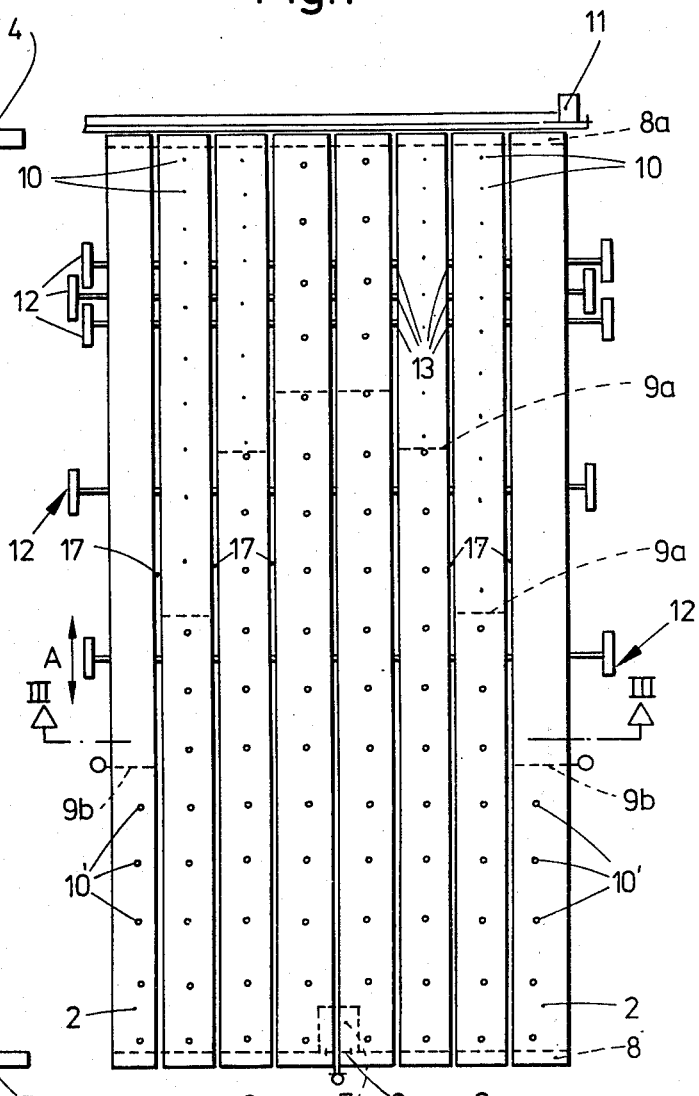
FIG. 1 shows a diagrammatic top plan view of a stacking table according to the invention.
Figure 5:
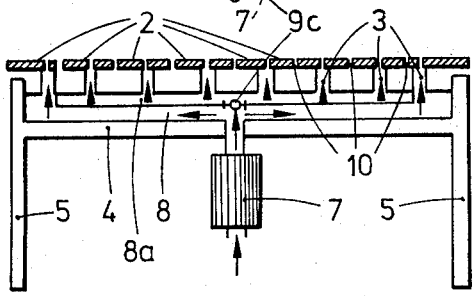
FIG. 5 shows a diagrammatic end view of the table of FIG. 1.

Each strip 2 is carried by a girder 3 also extending in the running direction. As shown in FIG. 5, girders 3 are supported at both ends of table 1 on respective end frame members 4. Table legs 5 are connected to end frame members 4. Lateral frame members 6 extend parallel to girders 3 over the full length of table 1 at both sides thereof. One end frame member 4 of table 1 carries a blower 7 for supplying air to air jets 10, 10' in strips 2 via transverse channels 8, **8*a*, 8*b* and longitudinal channels 9 formed in girders 3. Located at the table end opposite blower 7 is a cutting device 11**.

Figure 3:
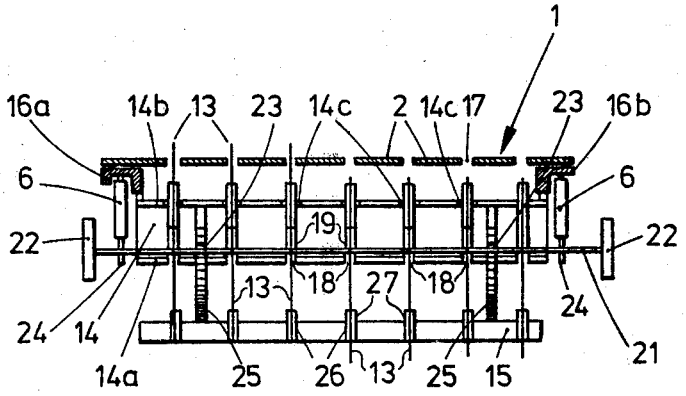
FIG. 3 shows a cross-sectional view of the table taken along the line III—III in FIG. 1.
Figure 4:
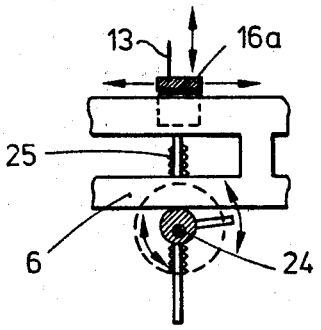
FIG. 4 shows an enlarged detail of the arrangement shown in FIG. 3.
Figure 6:
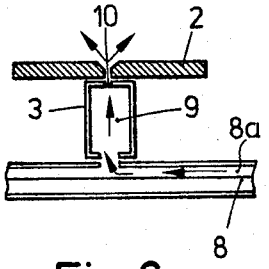
FIG. 6 shows an enlarged detail of FIG. 5

Table 1 further carries a number of transversely extending supports 12 for needles 13 adapted for longitudinal movement in the direction of arrow A. FIG. 3 shows one of the needle supports 12 and its location relative to strips 2 and longitudinal frame members 6 of table 1, girders 3 being omitted in this figure for clarity. Each needle support 12 includes an upper and a lower cross member 14 and 15, respectively. Upper cross member 14 is of generally U-shaped cross section, with its legs **14*a*, 14*b* extending parallel to the plane of the table top. Upper leg 14*b* carries a sliding shoe 16*a*, 16*b*, respectively, at each end. Sliding shoes 16*a*, 16*b* serve to support needle carrier 12 on lateral frame members 6. Slide shoe 16*a* is of generally U-shaped cross section so as to stradle the upper edge of frame member 6. The other slide shoe 16*b* is of generally L-shaped cross-section, one of its legs resting on the upper edge of the respective frame member 6. The upper leg 14*b* of cross member 14 is formed with through-openings 14*c* at center spacings substantially corresponding to the width of an individual table top strip 2. Openings 14*c* are arranged with their center axes subjacent slots 17 extending between adjacent strips 2 in the longitudinal direction of table 1**.

Lower leg **14*a* of upper cross member 14 is formed with through-openings 18 in alignment with openings 14*c* of upper leg 14*b*. Each opening 18 is surrounded by a sleeve 19 of annular cross-section and an interior diameter corresponding to that of opening 18. Each sleeve 19 is formed with slots 20 extending in a plane parallel to lower leg 14*a*** and spaced therefrom.

Upper cross member 14 further carries a rotatably mounted shaft 21 having a hand wheel 22 attached to both of its ends. Intermediate hand wheels 22, shaft 21 carries two gears 23 affixed thereto in spaced relationship. Shaft 21 further supports two rotatable eccentric discs 24 located below slide shoes **16*a* and 16*b*, respectively for clamping them against frame member 6 to fix needle support 12** in a selected position.

Figure 7:
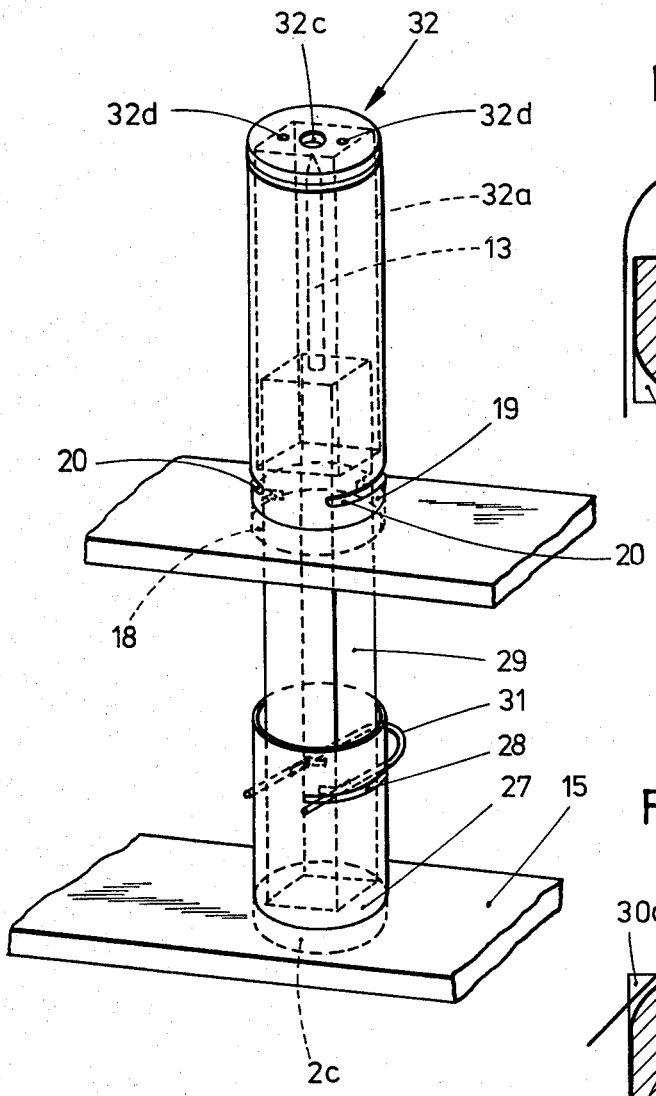
FIG. 7 shows a further enlarged perspective view of a detail of FIG. 3.

Lower cross member 15 is suspended from gears 23 by means of toothed racks 25. Lower cross member 15 is provided with through openings 26 surrounded by sleeves 27 in the same number and arrangement as lower leg **14*a* of upper cross member 14. Similar to sleeves 19, sleeves 27 are formed with slots 28 at positions rotated by an angle of 45° relative to slots 20 of sleeves 19. The arrangement of sleeves 19 and 27 with their slots 20 and 28, respectively, is shown in FIG. 7. This figure also shows the manner in which the needles 13 shown diagrammatically in FIG. 3** are retained in the cross members.

Figure 8:
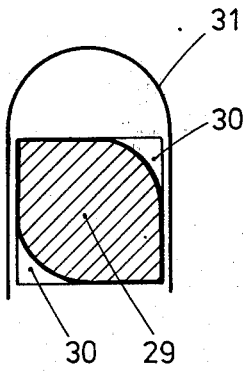
FIG. 8 shows a diagrammatic cross-sectional view of a detail of FIG. 7.
Figure 9:
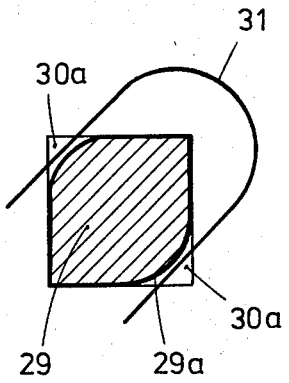
FIG. 9 shows a further detail of FIG. 7 similar to FIG. 8.

As shown in FIG. 7, each needle 13 is fixed in a needle socket 29 in the shape of a quadrangular body provided with slots 30, **30*a* in opposite edges at two vertically spaced planes, the upper slots 30 being formed in one pair of opposite edges, and the lower slots 30*a* in the other. In the respective plane, each slot has the shape of an isosceles triangle the right angle and the cathetes of which correspond to the edge and side of the needle socket, respectively, while the hypotenuse is arched inwards of the triangle surface. FIGS. 8 and 9 show cross sections of the needle socket 29 in the planes of the upper and lower slots, respectively. It is seen that the remaining portion of the rectangular body in the planes of slots 30 and 30*a* has a convex rounded periphery 29*a* at opposite corners. Needle sockets 29 are locked to cross members 14 and 15 by means of locking clips 31 inserted into slots 20 and 28 of sleeves 19 and 27, respectively. In FIG. 7, locking clip 31 is inserted into slots 28 of lower sleeve 27, the position of the clip relative to slots 30*a* of needle socket 29 being shown in FIG. 9. In this position the needle socket is retained in sleeve 27 by the clip 31. FIG. 8 shows the corresponding position of a locking clip 31 inserted into upper sleeve 19 relative to needle socket 29. In this position socket 29 is vertically slidable relative to clip 31 and sleeve 19. If socket 29 is rotated by an angle of 45°, its locking engagement is reversed, i.e. it is released from sleeve 27 and locked in sleeve 19. Rotation of socket 29 is effected by means of a cover member 32 having a prismatic body 32*a* the interior cross-section of which is slightly greater than that of needle socket 29, while its exterior dimensions permit cover member 32 to be inserted into sleeve 19. At its upper end, prismatic body 32*a* carries a cover disc 32*b* the diameter of which is greater than that of sleeve 19, so that it is supported by the upper rim of sleeve 19. Cover disc 32*b* is formed with a center hole 32*c* for passage of the needle and two recesses 32*d* for inserting a tool used for rotating the cover member 32 and thus the needle socket 29** by an angle of 45°.

The apparatus described permits a fabric web 33 to be retained on stacking table 1 by means of the needles 13 in the following manner: The transverse needle supports 12 are moved in the direction of arrow A for aligning the respective needle rows in a desired position along the table. The selection of this position depends on the given pattern and shall be discussed below. In the selected position the needle supports 12 are locked to lateral frame members 6 by actuating excentric discs 24. The needles to be raised have to be locked to lower cross member 15 in the manner shown in FIGS. 7 and 9. The needles not to be raised are rotated by an angle of 45°, so that they are released from lower cross member 15 and locked within sleeves 19 of upper cross member 14 as shown in FIG. 8. Rotation of at least one hand wheel 22 causes lower cross member 15 to be raised with respect to its associated upper cross member 14. This causes the needles 13 locked to lower cross member 15 to extend their points through the center hole 32*c* of the respective cover members 32 and upwards through the slots 17 of the stacking table. The needles not to be extended between and above the table top strips 2 have previously been locked in their associated upper sleeves 19, so that they are retained by upper cross member 14 at a fixed level below the table top. During upward movement of lower cross member 15, the through openings 26 thereof ride upwards over the lower ends of the needle sockets 29, so that these now project from the underside of lower cross member 15, as shown in FIG. 3. The needles may be raised in consecutive increments, so that their points project above the topmost layer of a stack formed on the table just far enough to enable a subsequent layer to be impaled thereon.

Figure 10:
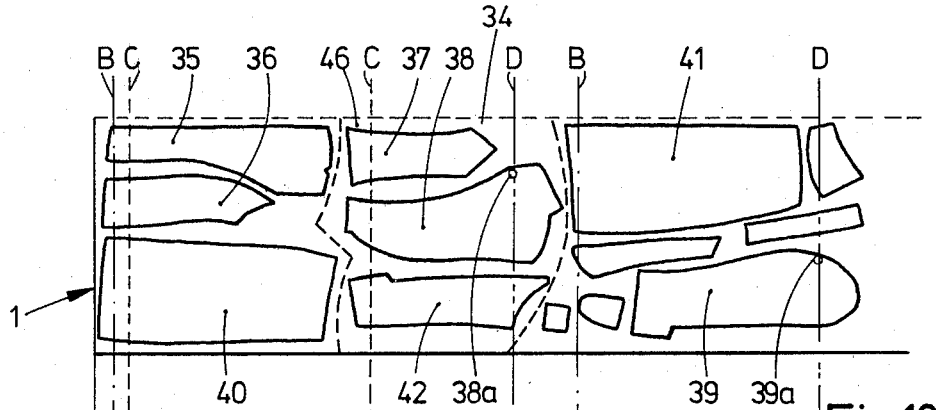
FIG. 10 shows a top plan view of a cutting pattern for use in the method according to the invention.
Figure 11:
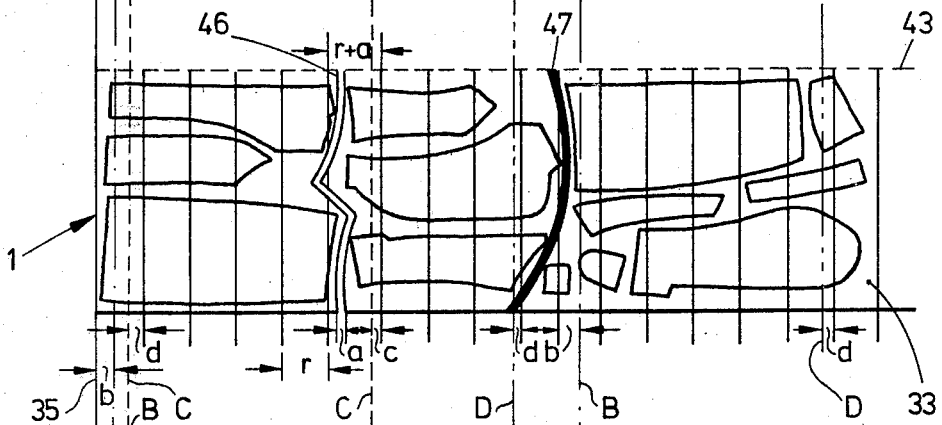
FIG. 11 shows a top plan view of a fabric web spread on the stacking table with a superimposed cutting pattern.
Figure 12:
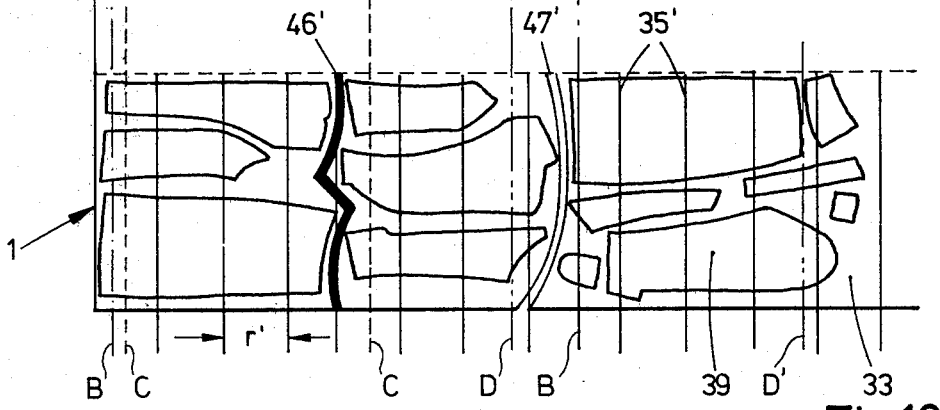
FIG. 12 shows a fabric web having a different repeat length spread on the stacking table.

FIGS. 10, 11 and 12 illustrate the method for pattern-aligned stacking of fabric webs 33 using the above described apparatus. Each of these figures shows a top plan view of stacking table 1.

In FIG. 10, the stacking table supports a cutting pattern 34 for a lady's suit. The various cuttings of the pattern are arranged with a view to the utilization of the available fabric in the most economical manner, i.e. with as little waste as possible. In addition, correlated cuttings to be sewn together with aligned patterns are disposed adjacent one another as far as possible. This is particularly the case with respect to back cuttings 35 and 36 and front cuttings 37 and 38. Other cuttings which also have to be sewn together with their patterns aligned are not, however, arranged in this manner: thus the front sleeve cutting 39 has to be joined at 39*a* to edge portion 38*a* of front cutting 38, and skirt back cutting 40 has to be joined to skirt front cutting 41 with the respective pattern aligned. Further pattern alignment is required between front cuttings 37 and 38 and coat back cuttings 35 and 36, respectively. In order to ensure correct pattern alignment for each of the consecutively stacked fabric web sections, the transverse needle rows are positioned along the table in accordance with pattern-correlated portions of the cutting pattern. This is effected as previously described by shifting the needle supports to the selected positions and subsequent raising of the needles. In FIGS. 10 to 12, the needle rows are shown in three correlated pairs: dash-dot lines B show the needle rows for skirt cuttings 40 and 41, dot lines C indicate the needle rows for back cuttings 35 and 36 and front cuttings 37 and 38, respectively, while dash-double dot lines D represent the needle rows extending through sleeve attachment points 38*a* and 39*a*. During stacking of the fabric webs, the same transverse line of the pattern repeat has to be aligned with the two needle rows of each pair.

FIG. 11 shows the manner in which a fabric web 33 is spread on the table with the needle rows B, C and D aligned in accordance with the given cutting pattern. The cutting pattern is again shown in this figure for better understanding. Web 33 is folded double along folding line 34. The fabric has a pattern as indicated by transverse lines 35 at a spacing r corresponding to the length of the pattern repeat. As seen in FIG. 11, both needle rows B are located at the same distance b from the transverse lines 35 to the left thereof. Similarly needle rows C are located at the same distance c from the transverse line 35 to the right thereof, and needle rows D are disposed at equal distances d from the transverse lines 35 to the right thereof.

In order to achieve this correlation, the pattern repeat of web 33 has to be aligned with the fixed needle rows, starting for instance at the lefthand end in the drawing. The fabric web is first impaled on needle rows B and C. At this point it is to be noted that the two separate needle rows B and C adjacent the lefthand end might be replaced by a single needle row, in which case the correlated second needle row C would have to be shifted accordingly. For a better understanding of the present method, however, the needle rows are shown in a paired arrangement.

After the fabric web has been impaled on needle rows B and C, a first pattern alignment is to be carried out with respect to the second needle row C. Proper alignment of the pattern with respect to this needle row requires the fabric to be shifted a small distance to the right. To this effect, the web is cut along a separation line 46, so that its righthand portion can be shifted by a corresponding amount a. Separation line 46 as well as a further separtion line 47 are already indicated in the cutting pattern at regions extending transversely between individual cuttings to permit shifting of the fabric sections without disturbing the alignment of the cuttings to the left or right of these regions. Cutting of the web along separation line 46 results in the distance between the transverse lines 35 adjacent thereto being increased to a+r, as shown in FIG. 11.

The next pattern alignment is to be carried out with respect to the second needle row B. In this case, the pattern alignment requires shifting of the web to the left. The fabric is therefore not cut along separation line 47, but folded over itself, resulting in the distance r between transverse lines 35 adjacent this region being somewhat shortened. A further pattern alignment with respect to needle row D is not required in the present example.

In the above described manner, a plurality of fabric webs may be impaled on the needle rows to form a stack. If this stack is then cut in accordance with the cutting pattern, the resulting cuttings are adapted to be joined to a finished textile article with properly aligned pattern.

FIG. 12 shows a fabric web 33′ which is also to be cut in accordance with the cutting pattern of FIG. 10. The pattern of web 33′ has a pattern repeat of greater length, however, than the pattern of web 33 in FIG. 11. This is indicated in FIG. 12 by transverse lines 35′ at mutual spacings r′. The needle rows B, C and D previously positioned in accordance with the cutting pattern and used for stacking fabric webs 33 may be left substantially unaltered, so that resetting thereof is not required. The pattern alignment has to be carried out in a different manner, however, the fabric having to be folded over itself at separation line 46′ and to be cut and shifted apart at separation line 47′. In addition, the greater length of the pattern repeat results in the pattern not being properly aligned with respect to the second needle row D associated with the front sleeve cutting 39. In order to avoid excessive fabric waste, the cutting pattern was slightly modified by shifting sleeve cutting 39 and the associated needle row D′ a small distance to the left.

In FIGS. 10 to 12 the needle rows B, C and D are shown to extend continuously over the full width of the stacking table. It is also possible, however, to form transversely interrupted needle rows having gaps between individual cuttings, by rotating the corresponding needles with their sockets to reverse their locking engagement, so that they are not raised above the table top.

The finished stack formed in the above described manner has a considerable weight. To facilitate its removal from the table, blower 7 is energized to supply compressed air to air jets 10, 10' for lifting the stack from below. Initially the stack covers mainly the end portion of the table adjacent the cutting device 11, from where it is to be moved towards the other end of the table for removal therefrom. For concentrating the air supply to the first-named end portion or shifting zone, the closure flap 9*c* is initially left closed, and pressurized air is supplied to the jets 10 of the shifting zone via opened flaps 9*b*, channels 9 in outer girders 3 and the transverse channel 8*b* remote from the blower 7. Subsequently flap 9*c* is also opened to feed pressurized air to the jets 10' of the removal zone via transverse channel 8*a*. This results in a decrease of the intensity of the air streams exiting from the individual jets, the resulting air cushion is still sufficient, however, to carry the stack towards the removal zone at the blower end of the stacking table. Finally the flaps 9*a* in the outer air channels are closed, so that the air pressure in the removal zone increases to facilitate removal of the stack from the stacking table.

In another embodiment of the invention, the pressurized air supply to the two zones may be accomplished in a different manner. The girder air channels may thus be interconnected adjacent the blower end of the table via a common transverse channel provided with closure flaps on both sides of one or two central girder channels extending over the full length of the table without any separation walls therein. With the flaps closed, these channels supply pressurized air only to the shifting zone. For supplying air only to the removal zone, the center channel, or channels, respectively, may be closed by means of flaps adjacent the transverse channel at the opposite end of the table.

The integration of the air channels within the girders as shown in the drawings is particularly advantageous, it is also possible within the scope of the invention, however, to employ other shapes, particularly open profiles for the girders in combination with separate air ducts.

I claim:

1. A stacking table having a substantially flat top surface upon which fabric web sections can be stacked for simultaneous cutting, and having upright needles that can project above said surface for impalement of successive web sections at predetermined points in a pattern of the fabric, to enable stacking of the web sections in pattern-aligned relation to one another and establishment of cutting pattern elements in a predetermined relationship to the fabric pattern, said stacking table being characterized by:

A. frame;

B. a plurality of elongated strips supported by said frame in lengthwise parallel substantially coplanar relationship to one another and cooperating to define said top surface, said strips being laterally spaced apart to define elongated slots between them;

C. a plurality of elongated needle supporting elements;

D. cooperating means on the frame and on each needle supporting element for mounting the needle supporting element on the frame beneath said strips and extending transversely to them;

E. each of said needle supporting elements having a plurality of upwardly projecting needles mounted thereon at locations vertically aligned with said slots;

F. said cooperating means for each needle supporting element further comprising means guiding the needle support element for motion lengthwise of the strips to enable simultaneous adjustment of the plurality of needles on said element as to their position lengthwise along the respective slots; and G. means for holding said needles, so that each such needle can project up through one of said slots.

2. The stacking table of claim 1, further characterized by:

F. each of said needle supporting elements comprising elongated parallel upper and lower members, (1) said members being in vertically superimposed relation and being constrained to unison position-adjusting movement lengthwise of said strips, and (2) one of said members being adjustable up and down relative to the other; and G. means for selectably and alternatively securing each needle (1) to said one member of its needle supporting element to be constrained to adjusting up and down motion therewith or (2) to said other member of its needle supporting element to be confined in a position in which its upper end is below said top surface.

3. The stacking table of claim 2, further characterized by said means for selectably and alternatively securing each needle to said one or said other member of its needle supporting element comprising.

(1) an elongated body member of substantially square cross-section to which the needle is coaxially secured, said body member having (a) a first pair of slots on one plane substantially normal to its axis, in one pair of its opposite corners, and (b) a second pair of slots, in the other pair of its opposite corners, on another plane spaced from and parallel to said one plane;

(2) a pair of tubular sleeves, one secured to each of said members of the supporting element for the needle, said sleeves (a) being coaxial with one another and (b) having an inside diameter to receive said body member and confine it to lengthwise motion and to rotation about its axis; and (3) a pair of substantially U-shaped spring clips, one for each of said sleeves, each sleeve being slitted to receive its clip with the legs thereof parallel to the legs of the other clip and in straddling relation to the body member, so that with the body member in one rotational position the legs of one clip are engaged in one of said pairs of slots and in another rotational position the legs of the other clip are engaged in the other of said pairs of slots.

4. The stacking table of claim 2, further characterized by:

(1) a pinion confined to rotation on each of said needle supporting elements;

(2) a hand wheel on each of said needle supporting elements connected with the a pinion thereon for adjustingly rotating the same; and (3) a rack connected with said one of the members of each needle supporting element and meshingly engaged with the a pinion on that element to provide for up and down adjustment of said one member by rotation of the handwheel.

5. The stacking table of claim 1, further characterized by:

(1) at least certain of said strips having upwardly opening air outlets therein; and (2) means for delivering pressure air to said air outlets to be blown upwardly out of the same.

6. The stacking table of claim 5 wherein said means for delivering pressure air to said air outlets comprises girders lengthwise underlying said strips to support them, said girders defining lengthwise extending air channels.

7. The stacking table of claim 1, further characterized by: said cooperating means for mounting each needle supporting element on the frame comprising (1) elongated frame members at opposite sides of the table that extend lengthwise parallel to said strips; and (2) a slide shoe at each end of each needle supporting element, (a) the slide shoe at one end of the needle supporting element being U-shaped and straddling the top of one of said frame members, and (b) the slide shoe at the other end of the needle supporting element being L-shaped with one leg overlying the top of the other of said frame members and its other leg projecting downwardly alongside that other frame member.

8. The stacking table of claim 7, further characterized by: a cam member eccentrically rotatable on each needle supporting element adjacent to the underside of one of said frame members and cooperable with the slide shoe engaging that frame member to releasably clamp that frame member and confine the needle supporting element against lengthwise motion along the frame members.

* * * * *